US005530994A

United States Patent [19]

Loeffler

[11] Patent Number: 5,530,994

[45] Date of Patent: Jul. 2, 1996

[54] DUST AND TRASH REMOVAL SYSTEM FOR CARDING MACHINES

[75] Inventor: Walter Loeffler, Neubulach, Germany

[73] Assignee: Hollingsworth GmbH, Neubulach, Germany

[21] Appl. No.: 309,326

[22] Filed: Sep. 19, 1994

[30] Foreign Application Priority Data

Jun. 28, 1994 [DE] Germany ..... 44 22 655.1

[51] Int. Cl.[6] ..... D01G 15/34

[52] U.S. Cl. ..... 19/109; 19/104

[58] Field of Search ..... 19/95, 108, 109, 19/110, 113, 104; 15/93.1, 236.01, 236.07, 242

[56] References Cited

U.S. PATENT DOCUMENTS

| | | | |
|---|---|---|---|
| 3,036,343 | 5/1962 | Strang | 19/104 |
| 4,314,387 | 2/1982 | Löffler | 19/104 X |
| 4,438,549 | 3/1984 | Silander | 19/107 |
| 4,505,005 | 3/1985 | Stachli | 19/95 X |
| 5,022,121 | 6/1991 | Rutz | 19/109 X |
| 5,075,930 | 12/1991 | Carey et al. | 19/104 |

FOREIGN PATENT DOCUMENTS

| | | | |
|---|---|---|---|
| 2032478 | 5/1980 | United Kingdom | 19/107 |
| 9011392 | 1/1990 | WIPO | 19/108 |

*Primary Examiner*—Ismael Izaguirre
*Attorney, Agent, or Firm*—Townsend and Townsend and Crew

[57] ABSTRACT

The present invention relates to a dust and trash removal system for carding machines or cards including a cylinder and fixedly mounted carding segments cooperating therewith. The system comprises a mote knife having a blade section whose blade is arranged in a direction opposite to the running direction of the cylinder at a small distance from the surface of the cylinder, as well as a hold-down element arranged in the running direction of the cylinder upstream of the mote knife with a base surface that extends substantially in parallel with the surface of the cylinder. To improve the discharging characteristics for dirt particles, short fibers, or the like, the blade, when being viewed in cross-section, has at least one rounded section with a radius greater than 1 mm.

36 Claims, 4 Drawing Sheets

DUST AND TRASH REMOVAL SYSTEM FOR CARDING MACHINES

BACKGROUND OF THE INVENTION

The invention relates to a dust and trash removal system for carding machines or cards including a cylinder and carding segments cooperating therewith, said means comprising a mote knife having a blade section whose blade is arranged in a direction opposite to the running direction of the cylinder at a small distance from the surface of the cylinder, as well as a hold-down means arranged in the running direction of the cylinder upstream of the mote knife with a base surface extending substantially in parallel with the surface of the cylinder.

Such a dust and trash removal system is, for instance, known from DE-A-2846109. Dust and trash removal systems of this type are used in carding machines for removing the dirt particles still remaining in the fibers, as well as fiber fragments and shortened fibers. However, it often happens that part of the dirt particles to be discharged remain in the fibers and that fibers which are to be further processed, so-called material fibers, are discharged. As a consequence, the cleaning results are unsatisfactory on the whole.

SUMMARY OF THE INVENTION

It is the object of the present invention to develop a dust and trash removal system of the above-mentioned type in such a manner that in the discharged waste the ratio of dirt particles, fiber fragments and short fibers on the one hand to material fibers on the other hand is improved in such a manner that the amount of discharged good fibers is reduced and the amount of discharged trash, dust and short fibers is increased.

This object is attained according to the invention in that the blade, when being viewed in cross-section, has at least one rounded section with a radius greater than 1 mm.

As for the achievement of the present invention, it has been found that the proportion of discharged good fibers is considerably reduced and the proportion of discharged trash, dust and short fibers is considerably increased at the same time.

It has turned out that it is advantageous when the radius is between 1 and 5 mm and the mote knife is designed as a substantially plate-shaped structure with a contact side for mounting on a carding segment and a front side in parallel therewith, and that the mote knife extends substantially over the whole width of the cylinder.

Furthermore, the blade may have a front side arranged in a direction opposite to the running direction of the cylinder and a back side arranged in the running direction of the cylinder, the front and back sides being possibly interconnected by the rounded section. The front and back sides may here enclose an angle of about 70°. The front side may extend in parallel with the planar extension of the mote knife.

In another embodiment the front side may be inclined by about 10° relative to the planar extension of the mote knife.

The cleaning result may be improved by the front and back sides of the blade passing tangentially into the rounded section.

It has been found to be advantageous to the operation of the dust and trash removal system when the back side of the blade lies in an imaginary plane which encloses an angle of about 10° with a vertical plane relative to the planar extension of the mote knife.

In another embodiment the radius of the rounded section may substantially correspond to the thickness of the mote knife.

To simplify manufacture, the front side of the blade and the front side of the mote knife may be in one plane.

In another embodiment the thickness of the mote knife may be considerably smaller in the area of the blade than in the remaining areas of the mote knife.

In another embodiment the front side which is inclined by about 10° relative to the planar extension of the mote knife may be followed by a section which is inclined in the opposite direction, the front side and the inclined section forming a recess of the mote knife. A plurality of recesses may here also be arranged in waved configuration one after the other on the mote knife.

In an advantageous development of the invention the distance between blade and surface of the cylinder is variable.

Moreover, it has been found to be advantageous when the mote knife is adjacent to one of the carding segments.

To improve the cleaning results, at least one air supply duct may be provided according to the invention with at least one opening which is arranged in a direction opposite to the running direction of the cylinder in front of the base surface of the hold-down means in such a manner that an air current guided through the air supply duct can exit through the opening towards the surface of the cylinder. It has been found that with this kind of air guidance an improved discharge result can already be obtained in the sense of the invention even in cases where mote knives are used whose blades have a radius of less than 1 mm. Separate protection is therefore claimed for the air supply-duct.

In an advantageous development the opening may be arranged near the surface of the cylinder.

Moreover, the air supply channel may be defined by a carding segment and the hold-down means. The air supply duct can thus be implemented in an easy manner. To this end, the hold-down means may comprise a fastening section and a base section adjacent thereto, the base section carrying the base surface at its side facing the cylinder, and the fastening section defining the air supply duct together with the carding segment.

To this end, the fastening section of the hold-down means may be spaced apart from the carding segment, the distance between carding segment and fastening section being adjustable in such a manner that the cross-section of the air supply duct can be varied. The air supply duct may have a substantially rectangular shape when viewed in cross-section. A width of about 10 mm has been found to be optimum during operation. The cross-section of the air supply duct is normally constant over its length, but it is also possible that the air supply duct tapers towards the cylinder surface.

In order to regulate the amount of air passing through the air supply duct, there may be provided an air-supply regulating means for regulating the air current flowing through the air supply duct. To this end, the air-supply regulating means has preferably a tongue which can be moved into the air supply duct such that the cross-section of the air supply duct can be varied.

To obtain an especially simple air regulating means, said means may be designed as a substantially two-dimensional structure whose front section forms the tongue and whose rear section serves to receive fastening elements, and which is displaceably mounted on the upper side of a carding element in parallel with the running direction of the cylinder and can be fixed with the fastening elements above the carding segments. Moreover, the tongue may have an end section which is bent relative to the planar extension of the air-supply regulating means in such a manner that it projects into the air supply duct. The air-supply regulating means as well as the air supply duct advantageously extend over the whole width of the cylinder.

In an advantageous development of the invention the distance between the base surface of the hold-down means and the cylinder can be adjusted. The distance may be set down to zero where dirt discharge no longer takes place. A distance of from 0.25 to 25 mm between the base surface and the cylinder has been found to be advantageous to the operation of the dust and trash removal system.

In an advantageous development of the invention the gap created between the base surface and the cylinder tapers in the running direction of the cylinder.

In another embodiment the base surface of the hold-down means may have a curvature concavely facing away from the surface of the cylinder. It has been found that such a curvature effects an improved dirt discharge result. It has here been found to be of advantage when the base section of the hold-down means has an end section which faces the knife and whose end extends in a direction substantially perpendicular to the surface of the cylinder and away therefrom.

In an advantageous development of the invention, the clear width between the base surface and the blade section is variable. The clear width may here be reduced down to zero where dirt discharge no longer takes place.

Like the mote knife, the hold-down means may also extend over the whole width of the cylinder.

Furthermore, it has been found to be advantageous when the hold-down means is bent from a material whose thickness is considerably smaller than its planar extension. This allows low manufacturing costs on the hand and the formation of a cavity between hold-down means and mote knife on the other hand, with the cavity serving to accommodate a suction means for the good fibers or dust, trash and short fibers. In an advantageous development there is provided a cover between mote knife and hold-down means for forming a suction chamber enclosed by the hold-down means, the mote knife and the cover. The dust, trash and short fibers removal can thus be supplied via the suction chamber and a suction device into a receiving device provided for receiving the dirt particles.

The invention shall now be described in more detail with reference to several embodiment.

DESCRIPTION OF THE PREFERRED EMBODIMENTS

DESCRIPTION OF THE PREFERRED EMBODIMENTS

Figure 1:
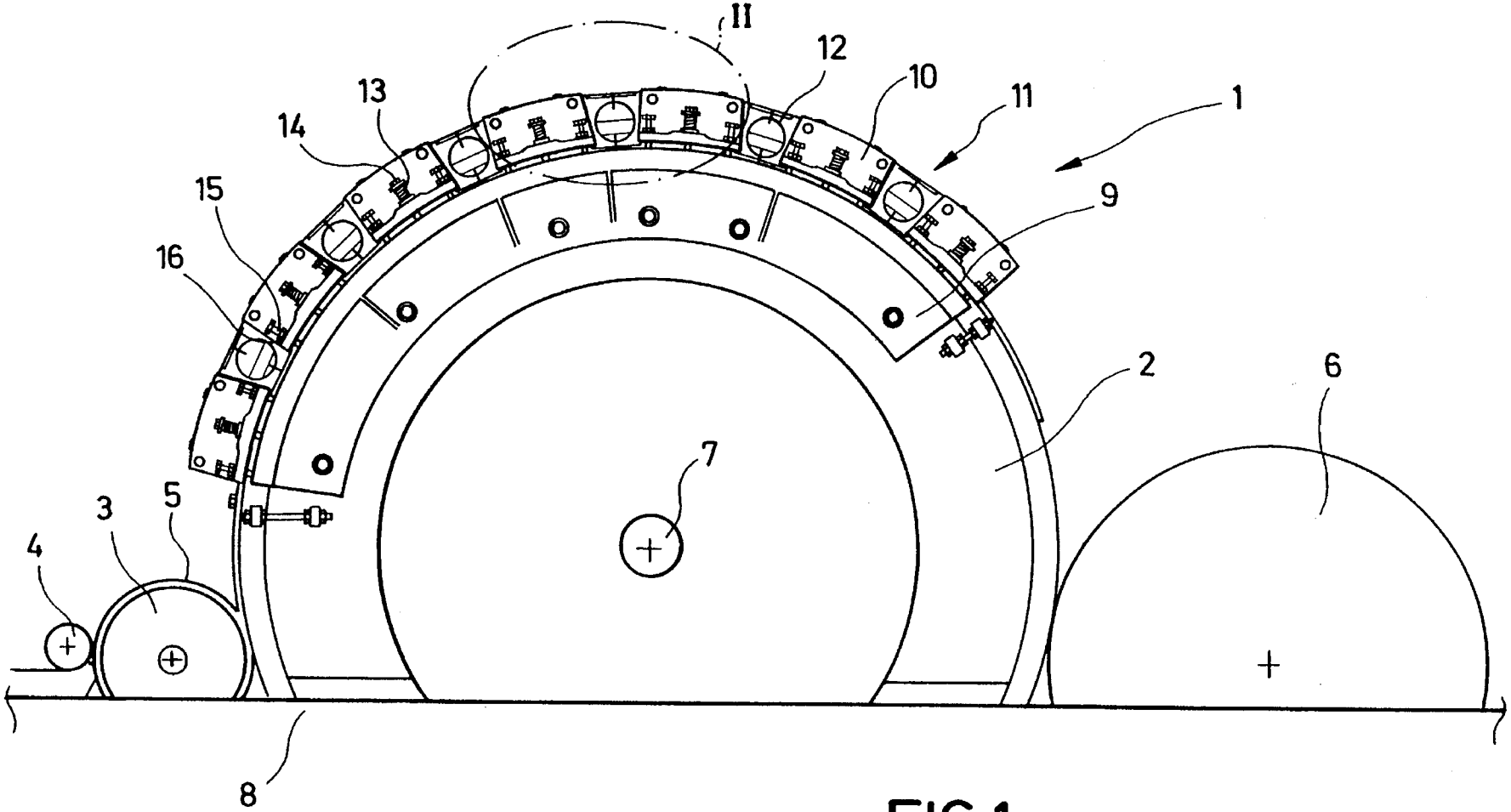
FIG. 1 is a lateral view of a carding machine comprising a cylinder, carding segments and the dust and trash removal system of the invention.

FIG. 1 diagrammatically illustrates a carding machine 1 comprising a cylindrical drum 2 with a running direction 1, as well as feed rollers 3 and 4 for feeding a fiber material 5, and a take-off roller 6 for removing the carded fiber material 5 from said drum or cylinder 2. Cylinder 2 has an axis 7. Moreover, the carding machine includes a frame 8, which is however only shown in part for the sake of clarity. Apart from the accommodation of drive motors, frame 8 serves to support cylinder 2, as well as feed rollers 3 and 5 and take-off roller 6. FIG. 1 additionally shows mounting means 9 for mounting carding segments 10. The mounting means 9 are of curved configuration and stationarily arranged near the cylinder, i.e., near the front side thereof.

Dust and trash removal systems 11 are provided between carding segments 10. Connections 12, which are diagrammatically illustrated, are provided on the dust and trash removal systems for suction devices (not shown). Each of the carding segments is connected to the mounting means 9 via fastening screws 14 loaded with a spring 13. Support means 15 for supporting carding segments 10 on mounting means 9 are provided at the ends of the dust and trash removal systems. The support means 15 which are formed as screws can be secured in a specific position via counter nuts 16. For the sake of clarity, only one respective carding segment 10, dust and trash removal system 11, connection 12, spring 13, fastening screw 14 and support means 15 with counter nuts 16 are shown.

Figure 2:
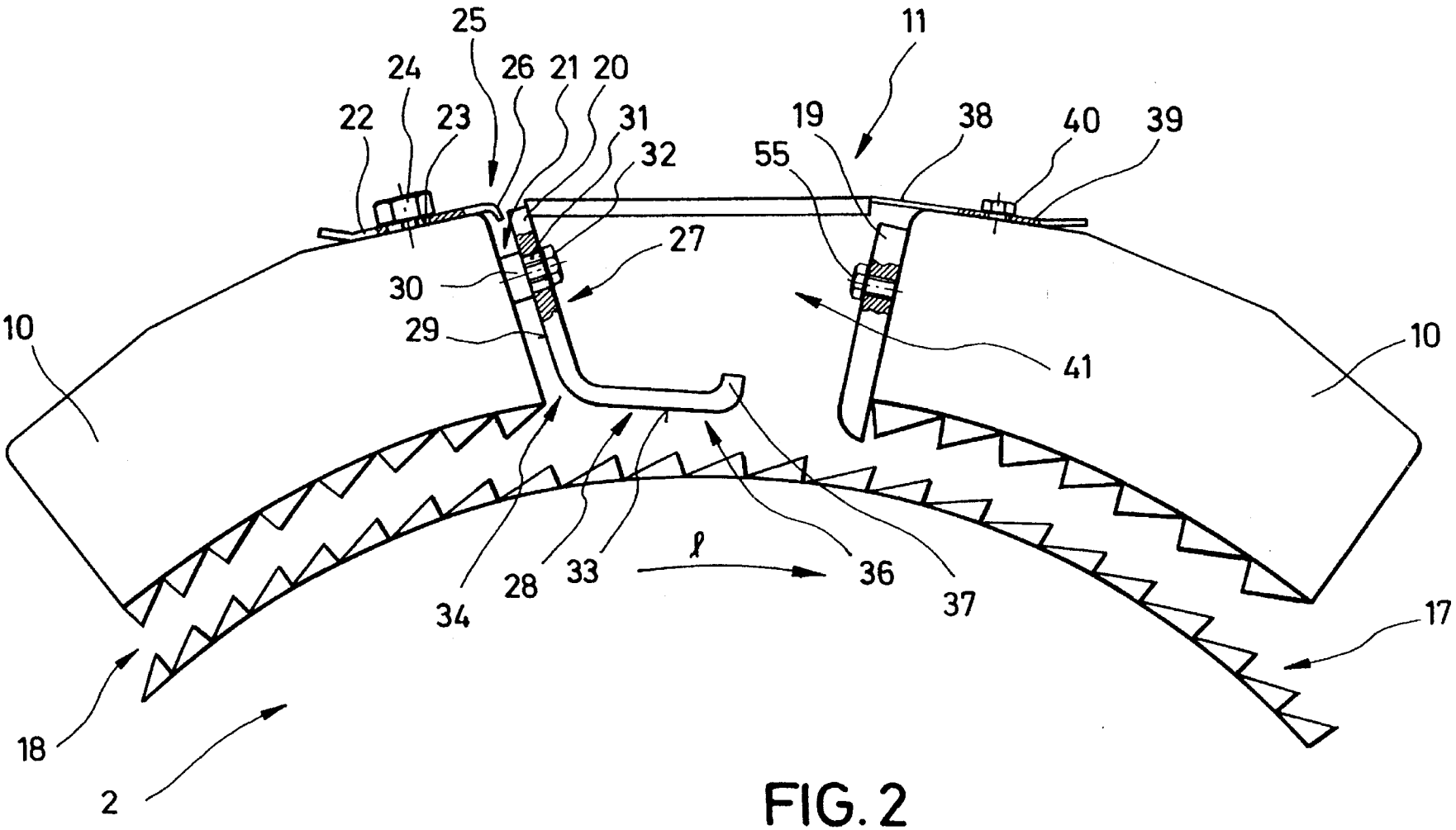
FIG. 2 is an enlarged view of the section shown in FIG. 1 and marked by II.

As becomes apparent from FIG. 2, the cylinder is provided with a surface 17 suited for carding fibers, and the carding segments with a corresponding surface 18; as becomes also apparent from FIG. 2, each of the carding segments 10 carries a mote knife 19. The adjacent carding segment 10 is provided with a hold-down means 20. An air supply duct 21 is positioned between the hold-down means 20 and the carding segment 10 assigned thereto.

The air supply duct is substantially shaped in the manner of a gap with a square cross-section and extends substantially over the whole width of cylinder 2. However, an air supply duct 21 which tapers towards cylinder 2 is also possible.

An air-supply regulating means 22 for regulating the cross-section of the air supply duct 21 and thus the air flow passing through the air supply duct 21 is positioned at the end of the air supply duct 21 which faces away from cylinder 2. The air-supply regulating means 22 extends substantially over the whole width of the cylinder and the air supply duct 21, respectively, and is designed as a two-dimensional structure and provided on the upper side of a carding element in contact therewith and is displaceable in the running direction in parallel with the surface of the carding element 10. Elongated holes 23 are provided for adjusting the air-supply regulating means 22. The air-supply regulating means 22 can be fixed in the customary manner relative to the carding segment 10 with a fastening element 24 which is designed as a screw. The front end of the air-supply regulating means 22 is designed as a tongue 25, with the front section 26 of said tongue projecting into the air supply duct 21.

Figure 7:
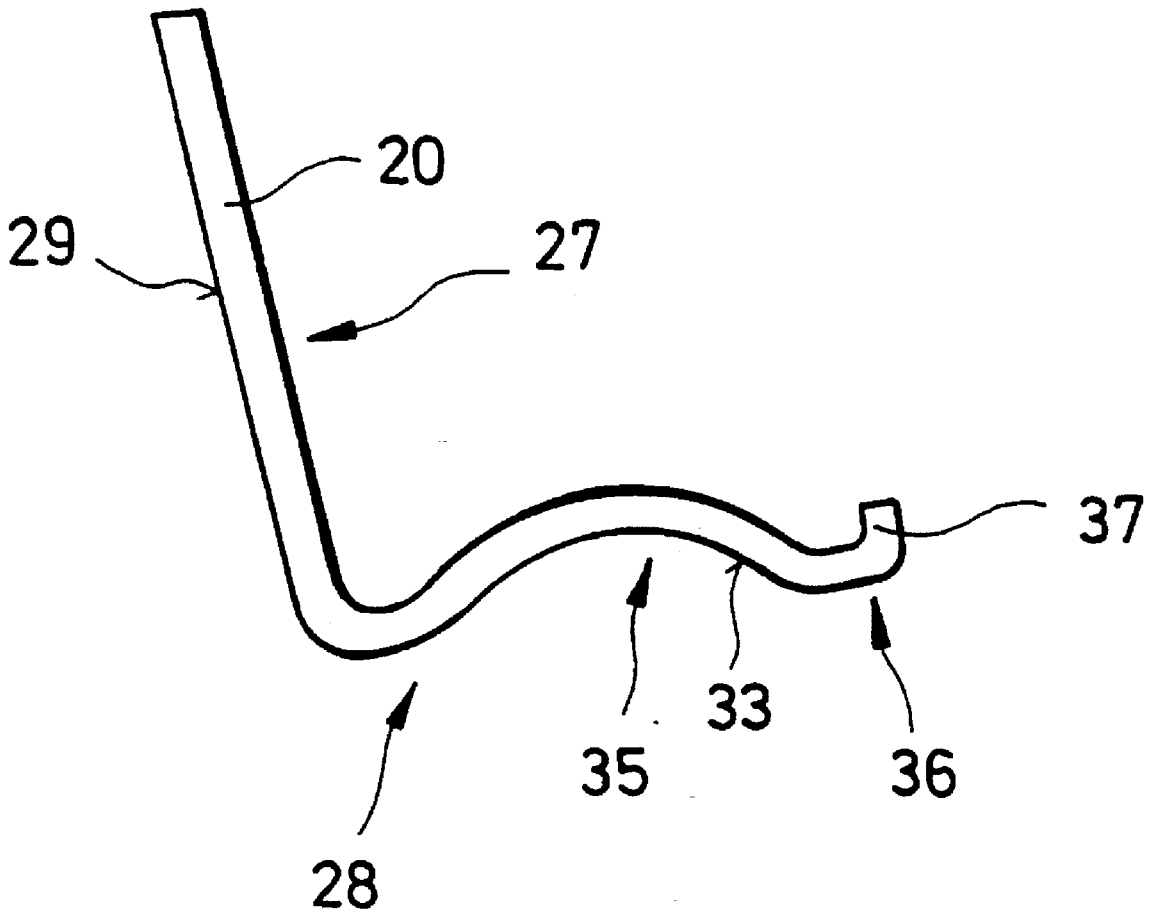
FIG. 7 shows a second embodiment of a hold-down means.

The hold-down means consists of a fastening section 27 and a base section 28. A fastening surface 29 which forms the air supply duct 21 together with carding segment 10 is provided at the side of the hold-down means which faces carding segment 10. The hold-down means 20 is spaced apart via a spacer 30 from the carding segment 10; a spacing of 10 mm has turned out to be optimum. To secure the hold-down means 20 onto carding segment 10, there are elongated holes 31, as well as fastening elements 32 which are designed as screws. To be able to adapt the air supply duct 21 to different airflow conditions, the distance between the fastening surface 29 and the carding segment 10 can be adjusted to lie between 5 mm and 30 mm. A base surface 33 which faces cylinder 2 is provided on its base section 28. The spacing of the base surface 33 relative to the surface of cylinder 2 can be adjusted to lie between 0.25 mm and 25 mm. An end 37 which extends substantially in a direction perpendicular to the surface of the cylinder is provided on its end section 36 which faces mote knife 19. As becomes apparent from FIG. 7, base section 28 may have a curvature 35. As becomes apparent from FIG. 2, the air supply duct 21 comprises an opening 34 which is formed from the fastening surface of the hold-down means 20 and carding segment 10. The opening 34 is positioned near surface 17.

A cover 38 is provided on the carding segment 10 carrying the mote knife 19 at the upper side thereof. The cover is adjustable relative to the upper side of the carding segment 10 in the running direction of cylinder 2. To this end, elongated holes 39 are provided on cover 38, cover 38 being adapted to be fixed in the customary manner with the aid of fastening elements 40 designed as screws relative to the associated carding segment 10.

Both the hold-down means and the mote knife 19 and cover 38 extend substantially over the whole width of cylinder 2, thereby defining a suction channel 41. Suction channel 41 terminates in connections 12, as can be seen in FIG. 1.

Figure 6:
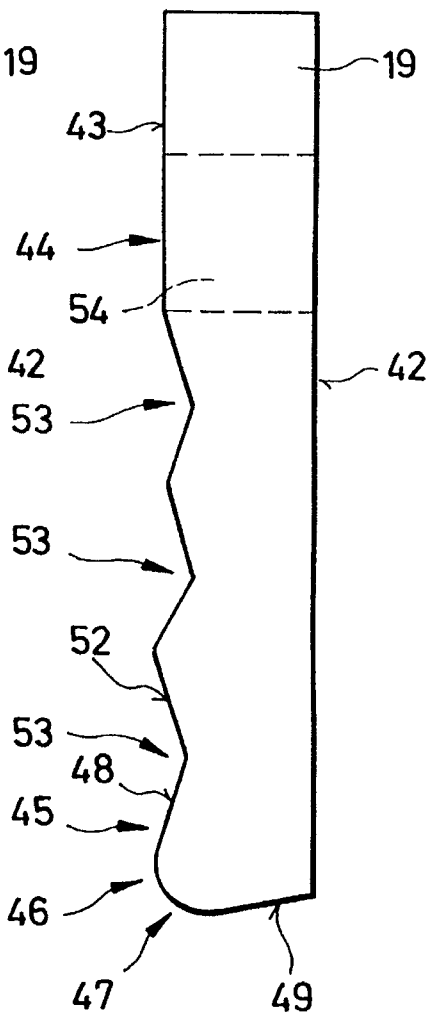
FIG. 6 shows a fourth embodiment of the mote knife.
Figure 5:
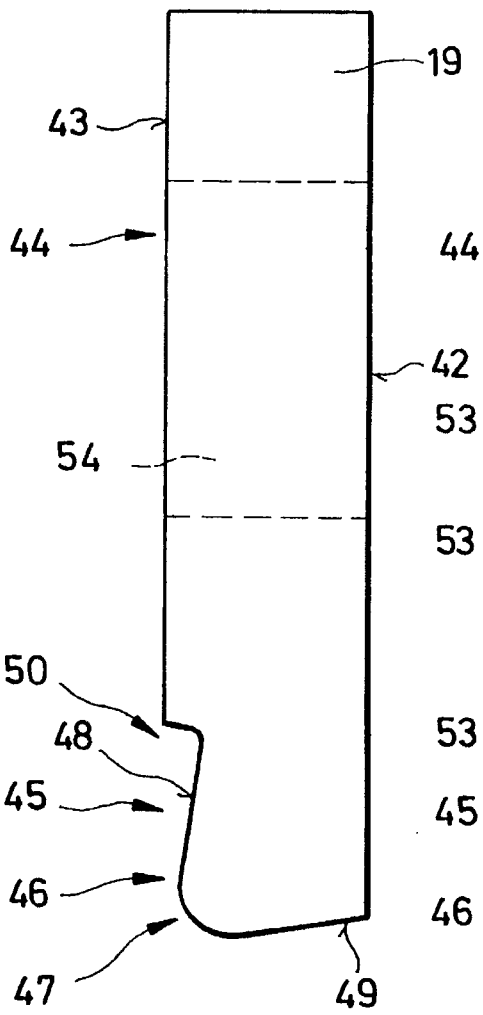
FIG. 5 shows a third embodiment of the mote knife.
Figure 4:
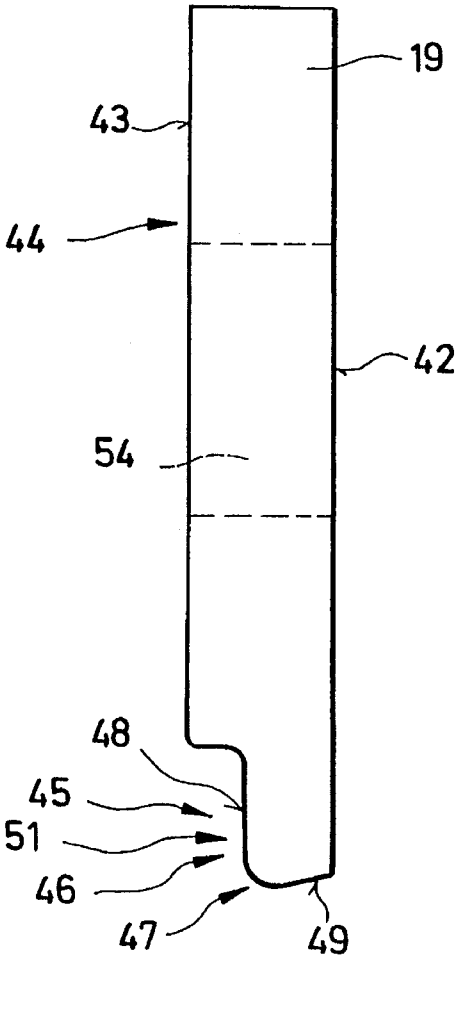
FIG. 4 shows a second embodiment of the mote knife.
Figure 3:
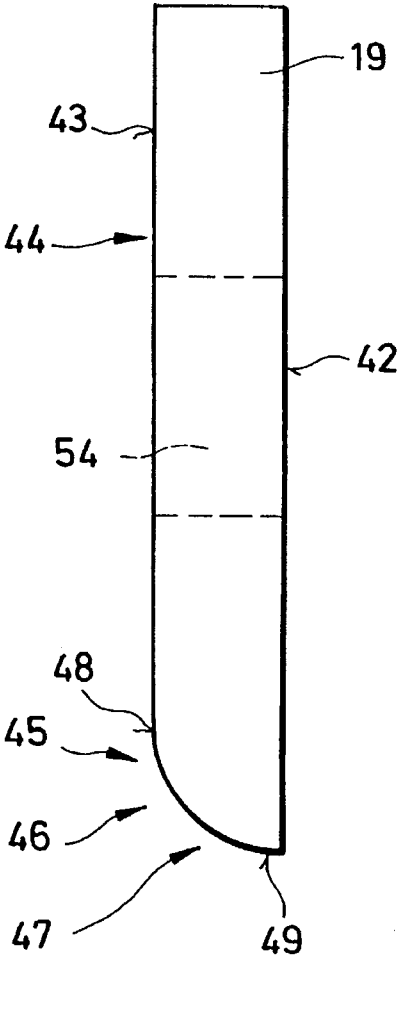
FIG. 3 shows a first embodiment of a mote knife.

As becomes apparent from FIG. 2, the mote knife is designed as a substantially plate-shaped structure and is provided with a contact side 42 for contact with a carding segment 10 and a front side 43. Contact side 42 and front side 43 are substantially in parallel with each other and form the fastening section 44 of the mote knife. A blade section 45 with a blade 46 is provided at the end of the mote knife 19 that faces cylinder 2. As becomes apparent from FIGS. 3, 4, 5 and 6, blade 46 is provided with a section 47 of rounded cross-section. Moreover, the blade consists of a front side 48 and a back side 49 which pass each tangentially into the rounded section 47. The radius of the rounded section 47 is within a range of from 1 to 5 mm, preferably between 2 and 4 mm. In the embodiments of FIGS. 4, 5, and 6, an angle of about 70° is enclosed between the front side 48 and the back side 49. In the embodiment of FIG. 3, the radius of the rounded section approximately corresponds to the thickness of the mote knife 19. In the embodiment shown in FIG. 4, the mote knife 19 is considerably smaller in the area of the blade section 45 than in the fastening section 44. As becomes apparent from FIGS. 4, 5 and 6, the front side 48 is inclined with respect to the planar extension of the mote knife 19 by about 10° relative to the middle plane of the mote knife 19. Furthermore, the back side 49 is inclined by about 15° relative to a vertical plane in a direction perpendicular to the planar extension of the mote knife 19. In the embodiment of FIG. 5, a recess 50 is created due to the geometry of mote knife 19. In the embodiment of FIG. 4, the front side 48 of the blade extends in parallel with the front side 43. A step 51 is created thereby. In the embodiment shown in FIG. 6, a section 52 which is inclined in the opposite direction and which forms a recess 53 together with the front side 48 follows the inclined front side 48. FIG. 6 shows three recesses 52 which are arranged one after the other in waved configuration.

Blade 46 of the mote knife 19 is oriented in a direction opposite to the running direction of cylinder 2. The distance between blade 46 and the surface of cylinder 2 can be adjusted. To this end, the mote knife 19 has provided thereon elongated holes 54 which are shown in broken line and through which the fastening elements 55, which are designed as screws, project for fixing the mote knife 19 in the conventional manner relative to the associated carding segment 10.

The operation of the invention shall now be explained in more detail in the following:

During operation of the carding machine 1, the fiber material 5 which is fed via feed rollers 3 and 4 is carded between cylinder 2 and carding segments 10. Dirt, trash and short fibers as well as fiber fragments and synthetic fibers are removed on blade 46 of the mote knife 19 and carried away via suction channel 41 and connections 12. It has been found that it is possible to remove dust, trash and short fibers or the like in a considerably improved manner when the blade is provided with a rounded section 47. Another improvement of the discharging properties of dust, trash and short fibers and the like can be achieved when an air current is introduced through the air supply duct 21. To be able to make an adaptation to the respective fiber materials 5, both the mote knife 19, the hold-down means 20 and the air-supply regulating means 22 can be adjusted, as described above. The discharging properties can be optimized due to the adjustability of these components.

It has been found during operation of the dust and trash removal system that the solution of the invention leads to a considerable increase in the amount of dust, trash and short fibers as well as fiber fragments and to a considerable decrease in the proportion of good fibres relative to the absolute amount removed.

I claim:

1. Dust and trash removal system for carding machines or cards comprising: a cylinder (2) and cooperating carding segments (10) cooperating therewith, the cylinder (2) having a surface (17), a mote knife (19) having a blade section (45) whose blade (46) is arranged in a direction opposite to a running direction (1) of said cylinder (2) at a small distance from the surface (17) of said cylinder (2), said blade (46) having a front side (48) arranged in a direction opposite to the running direction of said cylinder (2), and a back side (49) arranged in the running direction of said cylinder (2), and a hold-down means (20) arranged in the running direction of said cylinder (2) upstream of said mote knife (19) with a base section (33) that extends substantially in parallel with the surface (17) of said cylinder (2), characterized in that, when being viewed in cross-section, said blade (46) has at least one rounded section (47), whose radius is greater than 1 mm, interconnecting said front and back sides.

2. Dust and trash removal system according to claim 1, characterized in that said radius is between 1 and 5 mm.

3. Dust and trash removal system according to claim 1, characterized in that said front and back sides (48, 49) enclose an angle of about 70°.

4. Dust and trash removal system according to claims 1, wherein the mote knife (19) has a length, and characterized in that the front side (48) of said blade (46) extends in parallel with the length of said mote knife (19).

5. Dust and trash removal system according to claim 1, characterized in that the front side (48) of said blade (46) is inclined by about 10° with respect to the length of said mote knife (19).

6. Dust and trash removal system according to claim 1 characterized in that said front and back sides (48, 49) of said blade (46) tangentially pass into said rounded section (47).

7. Dust and trash removal system according to claim 1, wherein the mote knife (19) has a length, and characterized in that the back side (49) of said blade lies in an imaginary plane which encloses an angle of about 15° with a vertical plane passing through the length of said mote knife (19).

8. Dust and trash removal system according to claim 1, wherein the mote knife (19) has a thickness, and characterized in that the radius of said rounded section (47) substantially corresponds to the thickness of said mote knife (19).

9. Dust and trash removal system according to claim 1, wherein said mote knife (19) has a front side (43), and characterized in that the front side (48) of said blade (46) and the front side (43) of said mote knife (19) are in one plane.

10. Dust and trash removal system according to claim 1, characterized in that said mote knife (19) has a variable thickness which is substantially smaller in an area of said blade (46) than in the remaining areas of said mote knife (19).

11. Dust and trash removal system according to claim 1, characterized in that the front side (48) of said blade (46) is followed by a section (52) which is inclined in a direction opposite that of said front side (48), said front side (48) and said inclined section (52) forming a recess (53) of said mote knife (19).

12. Dust and trash removal system according to claim 11, characterized in that a plurality of said recesses (53) are arranged in a waved configuration one after the other on said mote knife (19).

13. Dust and trash removal system according to claim 1, characterized in that the distance between said blade (46) and said surface (17) of said cylinder (2) is variable.

14. Dust and trash removal system according to claim 1, characterized in that said mote knife (19) is adjacent to one of said carding segments (10).

15. Dust and trash removal system according to claim 1, wherein said hold-down means (20) has a base surface (33), and characterized in that the distance between said base section (33) of said hold-down means (20) and said cylinder (2) is adjustable.

16. Dust and trash removal system according to claim 15, characterized in that a gap is created between said base section (33) of said hold-down means (20) and said cylinder, said gap tapering in the running direction of said cylinder (2).

17. Dust and trash removal system according to claim 15, characterized in that said base section (33) of said hold-down means (20) has a curvature (56) facing concavely away from the surface of said cylinder.

18. Dust and trash removal system according to claim 1, characterized in that the base section (33) of said hold-down means (20) has an end section (36) facing said mote knife, the end of said end section being arranged in a direction substantially perpendicular to said surface (17) of said cylinder (2) and extending such that it moves away therefrom.

19. Dust and trash removal system according to claim 1, characterized in that the clear width between said base surface (33) and said blade section (45) is variable.

20. Dust and trash removal system according to claim 1, wherein the cylinder has a width, and characterized in that said hold-down means (20) extends over the whole width of said cylinder.

21. Dust and trash removal system according to claim 1, characterized in that said mote knife (19) is designed as a substantially plate-shaped structure with a contact side (42) for mounting on a carding segment (10) and a front side (43) in parallel therewith.

22. Dust and trash removal system according to claim 1, characterized in that said mote knife (19) extends substantially over the whole width of said cylinder (2).

23. Dust and trash removal system for carding machines or cards comprising: a cylinder (2) and cooperating carding segments (10) cooperating therewith, the cylinder (2) having a surface (17), a mote knife (19) having a blade section (45) whose blade (46) is arranged in a direction opposite to a running direction (1) of said cylinder (2) at a small distance from the surface (17) of said cylinder (2), and a hold-down means (20), having a base surface, arranged in the running direction of said cylinder (2) upstream of said mote knife (19) with a base section (33) that extends substantially in parallel with the surface (17) of said cylinder (2), characterized in that, when being viewed in cross-section, said blade (46) has at least one rounded section (47) whose radius is greater than 1 mm, and there is provided at least one air supply duct (21) with at least one opening (34) which is arranged in a direction opposite to the running direction of said cylinder (2) in front of the base surface (33) of said hold-down means (20) in such a manner that an air current guided through said air supply duct (21) exits through said opening (34) towards said surface (17) of said cylinder (2).

24. Dust and trash removal system according to claim 23, characterized in that said opening (34) is arranged near said surface (17) of said cylinder (2).

25. Dust and trash removal system according to claim 23, characterized in that said air supply duct (21) is defined by a carding segment (10) and said hold-down means (20).

26. Dust and trash removal system according to claim 23, characterized in that said hold-down means (20) comprises a fastening section (27) and a base section (28) next thereto, said base section (28) having a base surface (33) at its side facing said cylinder (2), and said fastening section (27) defining said air supply duct (21) together with a carding segment (10).

27. Dust and trash removal system according to claim 26, characterized in that said fastening section (27) of said hold-down means (20) is spaced apart from said carding segments (10), the distance between the carding segments (10) and the fastening section (27) being variable in such a manner that the cross-section of said air supply duct (21) is variable.

28. Dust and trash removal system according to claim 23, characterized in that the cross-section of said air supply duct (21) is constant.

29. Dust and trash removal system according to claim 27, characterized in that said air supply duct (21) tapers towards said surface (17) of said cylinder (2).

30. Dust and trash removal system according to claim 23, characterized in that an air-supply regulating means (22) is provided for regulating the air current flowing through said air supply duct (21).

31. Dust and trash removal system according to claim 30, characterized in that said air-supply regulating means (22) comprises a tongue (25) which can be moved into said air supply duct (21) such that the cross-section of said air supply duct (21) is variable.

32. Dust and trash removal system according to claim 31, characterized in that said air-supply regulating means (22) is a substantially two-dimensional structure comprising a front end section which forms said tongue (25) and a rear section which receives fastening elements (24), and said air-supply regulating means (22) being displaceably provided on an upper side of said carding segments in parallel with the running direction of said cylinder (2) and can be fixed with said fastening elements relative to said carding segments.

33. Dust and trash removal system according to claim 31, wherein said air-supply regulating means comprises a planar extension, and characterized in that said tongue (25) has an end section (26) which is bent relative to the planar extension of said air-supply regulating means (22) in such a manner that it projects into said air supply channel (21).

34. Dust and trash removal system according to claim 30, wherein said cylinder (2) has a width, and characterized in that said air-supply regulating means (21) extends substantially over the whole width of said cylinder (2).

35. Dust and trash removal system for carding machines or cards comprising: a cylinder (2) and cooperating carding segments (10) cooperating therewith, the cylinder (2) having a surface (17), a mote knife (19) having a blade section (45) whose blade (46) is arranged in a direction opposite to a running direction (1) of said cylinder (2) at a small distance from the surface (17) of said cylinder (2), and a hold-down means (20) arranged in the running direction of said cylinder (2) upstream of said mote knife (19) with a base section (33) that extends substantially in parallel with the surface (17) of said cylinder (2), characterized in that, when being viewed in cross-section, said blade (46) has at least one rounded section (47) whose radius is greater than 1 mm, and said hold-down means (20) is bent from a material having a planar extension and a thickness, said thickness being considerably smaller than said planar extension.

36. Dust and trash removal system according to claim 35, characterized in that a cover (38) is provided between said mote knife (19) and said hold-down means (20) for forming a suction chamber (41) enclosed by said hold-down means (20) and said mote knife (1) and said cover (38).

* * * * *